United States Patent [19]

Lüthy et al.

[11] 4,425,958

[45] Jan. 17, 1984

[54] LOW-PRESSURE CASTING METHOD AND LOW-PRESSURE CASTING APPARATUS

[75] Inventors: Hans Lüthy, Buchs; Eugen Isler, Niederrohrdorf; Ewald Meier, Unterehrendingen; Max Zimmermann, Niederrohrdorf, all of Switzerland

[73] Assignee: Egro AG, Niederrohrdorf, Switzerland

[21] Appl. No.: 322,063

[22] Filed: Nov. 16, 1981

[30] Foreign Application Priority Data

Dec. 23, 1980 [CH] Switzerland ..... 9495/80

[51] Int. Cl.[3] ..... B22D 17/06

[52] U.S. Cl. ..... 164/119; 164/72; 164/137; 164/267; 164/306; 164/343

[58] Field of Search ..... 164/113, 119, 137, 306, 164/309, 312, 316, 341-343, 72, 267

[56] References Cited

FOREIGN PATENT DOCUMENTS

| | | | |
|---|---|---|---|
| 493900 | 3/1930 | Fed. Rep. of Germany . | |
| 2004904 | 10/1971 | Fed. Rep. of Germany . | |
| 2231856 | 1/1973 | Fed. Rep. of Germany . | |
| 2447837 | 5/1975 | Fed. Rep. of Germany . | |
| 1500877 | 10/1967 | France . | |
| 1180370 | 2/1970 | United Kingdom . | |
| 709245 | 1/1980 | U.S.S.R. | 164/342 |
| 759221 | 8/1980 | U.S.S.R. | 164/342 |

*Primary Examiner*—Gus T. Hampilos
*Assistant Examiner*—Richard K. Seidel
*Attorney, Agent, or Firm*—Werner W. Kleeman

[57] ABSTRACT

With low-pressure or die-casting methods there frequently occur leaks during the transfer of the molten metal from the metal containing basin or vessel to the mold. These leaks often lead to serious accidents and related operating interruptions. According to the invention these problems are solved by a casting method, wherein all movements of the mold occur in a vertical plane. With a preferred embodiment of apparatus for the performance of the method the mold is placed in a positive or form-locking manner with its casting or pour opening upon the casting hole of the metal containing vessel or basin and pressed against the latter in a fluid-tight fashion by means of a pneumatic lifting cylinder. This affords the advantage of a simple connection of the mold with the basin and without requiring a coupling mechanism, and, additionally, the heating of the riser or up tube and/or immersion tube can be omitted, which otherwise conventionally was performed by gas heating.

7 Claims, 7 Drawing Figures

LOW-PRESSURE CASTING METHOD AND LOW-PRESSURE CASTING APPARATUS

BACKGROUND OF THE INVENTION

The present invention relates to a new and improved low-pressure or die-casting method and apparatus for the performance thereof.

Generally speaking, the method of die-casting molded parts or castings within a displaceable mold according to the invention and the apparatus for the performance thereof incorporates a pressure tight closed vessel or basin which is provided at its upper side with a casting hole or aperture equipped with a riser or up tube immersing into a part of the molten metal or melt. During the casting process the gas chamber located above the melt is acted upon by a gas pressure which forces the melt into the mold. After the solidification of the cast piece or casting the gas chamber located in the basin or vessel is vented of the gas pressure prevailing therein.

For many years casting molds have been manually fabricated. Accordingly, the molten metal is poured directly out of a melting furnace into a mold by means of a scoop. To prevent the formation of pipes at the casting the mold is carefully manually erected or lifted during the filling process. The forming, cooling and finishing of the mold equally is manually performed. This work requires great dexterity, experience and concentration of the caster and constitutes a considerable safety risk.

Thus, attempts have been made to mechanize or automate the casting process, i.e. the timewise correct erection of the mold during casting is accomplished by a machine, as is likewise the forming, cooling and finishing. The filling of the melt again was manually carried out by means of a scoop which still constituted a source of danger.

The mechanization or automation was further developed by resorting to the use of a rotary or turret table. The mold was erected upon the furnace through a gas-heated coupling system and the molten metal or melt was forced out of the furnace into the mold by compressed or pressurized air. By further turning or indexing the revolving table there were performed, partially automatically and partially manually, at appropriate stations the further working cycles known from manual casting operations.

It has been found that with casting devices of this type there occur leakage problems at the coupling system. With the notoriously well known, especially stringent requirements of a casting plant a rotary table only can be precisely guided for a very limited period of time. As a result, there frequently occur interruptions in the casting operation and serious accidents due to outflowing or pressed-out melt.

SUMMARY OF THE INVENTION

Therefore, with the foregoing in mind it is a primary object of the present invention to provide a new and improved low-pressure or die-casting method and an apparatus for the performance of such method, which are not afflicted with the aforementioned drawbacks and limitations of the prior art.

Another important object of the present invention is to provide a low-pressure casting method and an apparatus for the performance of such method, which are not prone to disturbance and malfunction and have a high efficiency or output.

It is still a further important object of the present invention to provide a new and improved low-pressure casting method and an apparatus for the performance of such method, wherein the safety risk is reduced with respect to conventional systems.

Now in order to implement these objects and others, which will become more readily apparent as the description proceeds, the low-pressure or die-casting method of the present development is manifested by the features that prior to the casting operation the mold is displaced in a vertical plane, that such mold together with its casting or pour opening is lowered to a position overlying the casting hole of the vessel or basin in a form-locking and congruent manner and pressed against the cover plate of the basin. Following the casting operation and the solidification of the cast piece or casting and the venting of the gas chamber the mold is further displaced in the vertical plane.

The apparatus for the performance of the low-pressure or die-casting method according to the present invention is manifested by the features that the mold is indirectly secured to a rail or track by means of a carriage. The rail is guided over the vessel or basin, the stripping station and the washing, drying and finishing station.

The method according to the invention and the apparatus for the performance of such method can be realized in a most simple manner and controlled with great reliability. By virtue of precisely positioning the mold above the casting aperture or hole of the melt containing basin or vessel or the like there is obtained a short, form-locking or positive connection, which allows for omitting a coupling system. Thus, heating of the riser or up tube is no longer necessary.

The low-pressure casting method of the invention further contemplates that following the venting of the gas chamber the mold is lifted-off in vertical direction and transported to a stripping station by performing a horizontal linear displacement of the mold. After opening the mold and removing the cast piece or casting, the mold is transported, during a further operating step, to a washing, drying and finishing station by accomplishing a linear displacement of the mold. This technique enables rational working and can be partially or entirely automated.

It is possible according to the invention for the mold halves of the mold to each be turned in a vertical plane through 90° and with their parting surfaces frontally lowered and immersed into a cooling and finishing emulsion bath contained at the washing station. This technique affords the advantage of a uniform cooling of the mold halves, prevents distortion thereof, and even with continuous operation ensures for reproducible thermal conditions during the casting process.

It is possible to insert the casting or mold core into the mold in that, in a first step, the mold is turned into an inclined position with the mold halves open, whereupon the casting or mold core is inserted, the mold closed and then turned back to its horizontal position. Owing to these operations the casting or mold core can be inserted into the open mold in a simple manner and without using auxiliary means.

According to a further feature of the die-casting apparatus according to the invention there is interposed between the carriage and the mold a hydraulic and/or pneumatic lifting and pivoting device. This apparatus can be controlled with great functional reliability.

An advantageous embodiment of such lifting or pivoting device, generally referred to herein as a displacement device, serving for instance for inserting the casting core, contemplates that such displacement device is provided with at least one pneumatic lifting cylinder and two pivot cylinders acting upon a double-armed lever.

A further feature of the apparatus according to the invention is manifested by the features that a respective locking cylinder is provided at each mold support arranged at the mold halves. This construction affords the advantage of a timewise correct closing of the mold.

A modification of the aforementioned apparatus can be realized in that the mold halves are parallely guided by means of four column guides. Such apparatus design serves for precisely guiding the mold halves during the closing operation and ensures for a prolonged service life of the mold.

The aforementioned lifting or pivoting device may be vertically guided by four column guides. These column guides enable an exact perpendicular or vertical lowering of the mold towards the crucible or basin. Thus, there is achieved a reproducible congruent transition between the casting hole of the metal containing basin and the casting opening of the mold.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
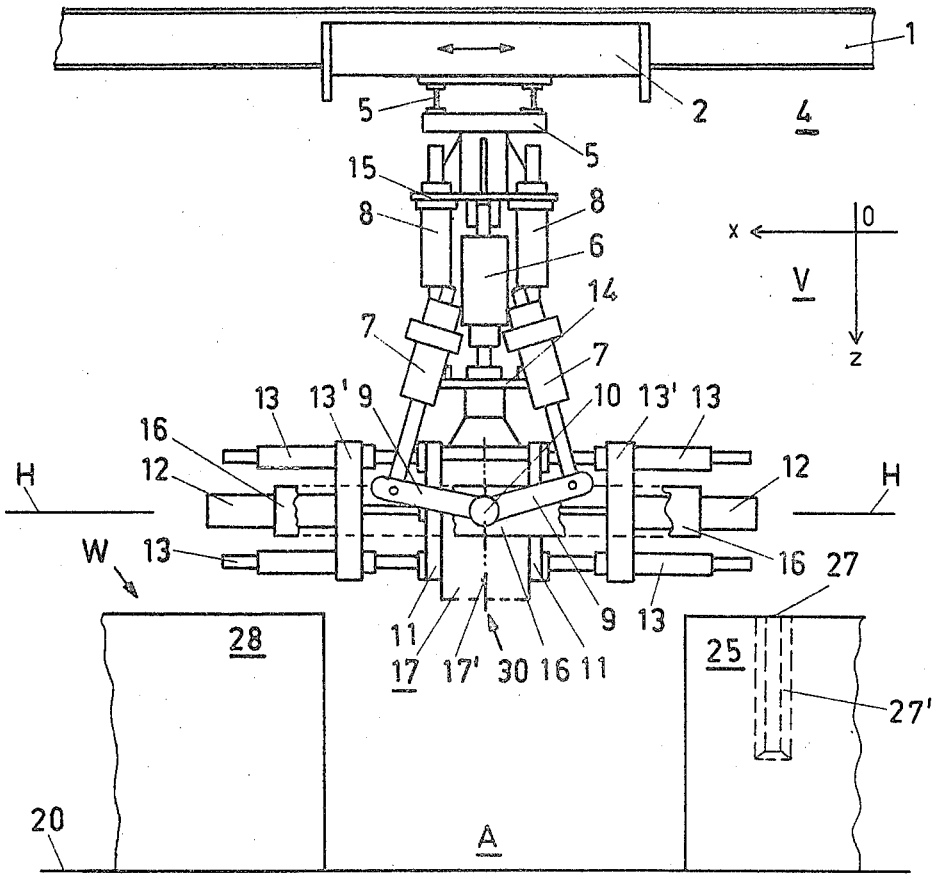
FIG. 1 illustrates a casting apparatus which is suspended at a track or rail over the central stripping station of a casting apparatus.

Describing now the drawings, in FIG. 1 the rail or track leading over a casting assembly or unit is generally designated by reference numeral 1. This track or rail 1 forms a yoke 4 by means of here not further illustrated suitable supports or carriers. A wheeled carriage 2 is displaceably arranged in conventional manner at the track or rail 1 for movement in the direction of the double-headed arrows indicated in the drawing. Secured to the carriage 2 is a suspension system 5 composed of two not particularly referenced double T-shaped supports provided with support plates. Vertically arranged at the center of the suspension system 5 is a lifting or displacement piston-and-cylinder arrangement 6 which, on the one hand, is secured to a suspension plate 15 and, on the other hand, acts by means of its piston upon a carrier plate 14 which can be lowered. Equally arranged at the carrier or support plate 14 and the suspension plate 15 are vertical column guides 8 which are arranged concentrically to the lifting or displacement cylinder arrangement 6.

Arranged at a frame 16, partially shown in cross-sectional view, is a mold support 11 comprising a closing cylinder 12, a substantially horizontal column guide 13 and a flange or plate 13'. At the center of the frame 16 there is located a rotary shaft 10 which is provided with a double-arm lever 9. Two pivot or swivel cylinders 7 act out of phase upon a related one of the ends of the double-arm lever 9.

A conventionally constructed mold 17, provided with a parting location or plane 17' and a casting or pour opening 30, is flanged to the mold support 11 and has been shown in the drawing of FIG. 1 by broken lines.

The casting apparatus of FIG. 1 is illustrated located above its stripping station A, wherein there is shown the side of such casting apparatus which faces away from the operator. On the left-hand side of the drawing there is arranged a cooling and finishing bath 28 and on the right-hand side a basin or vessel 25 provided with double chambers or compartments.

The course of movement of the casting apparatus under discussion is limited in x-direction by the track or rail 1 provided with the carriage 2 and by the rail supports or carriers, and in the z-direction by foundation or base plates 20 i.e. the foundation 18. All movements occur in a vertical plane V. In the illustrated arrangement, the frame 16 provided with the mold 17 is arranged substantially parallel to a horizontal plane H.

In the following description of the drawings the same or analogous elements have been generally designated by the same reference characters.

Figure 2:
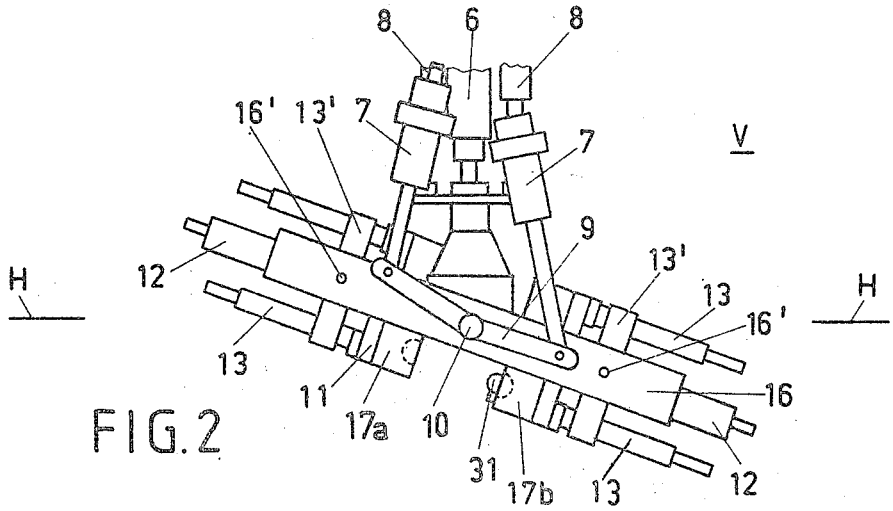
FIG. 2 illustrates the casting apparatus according to FIG. 1 shown in a tilted position and containing an inserted casting core.

In FIG. 2 the casting apparatus according to FIG. 1 has been illustrated in a position which is tilted or inclined by about 20° with respect to the horizontal plane H. This position is obtained by controlling the pivot or swivel cylinders 7 to function in an opposite sense, while correspondingly turning the double-arm lever 9 and its rotary shaft 16 which is fixedly connected to the frame 16. This position serves for inserting a casting core 31 into one of the two mold halves 17*a* and 17*b*.

Furthermore, there will be recognized the pivot or swivel shafts 16' arranged at the frame 16, the function of which will be more fully described hereinafter.

Figure 3:
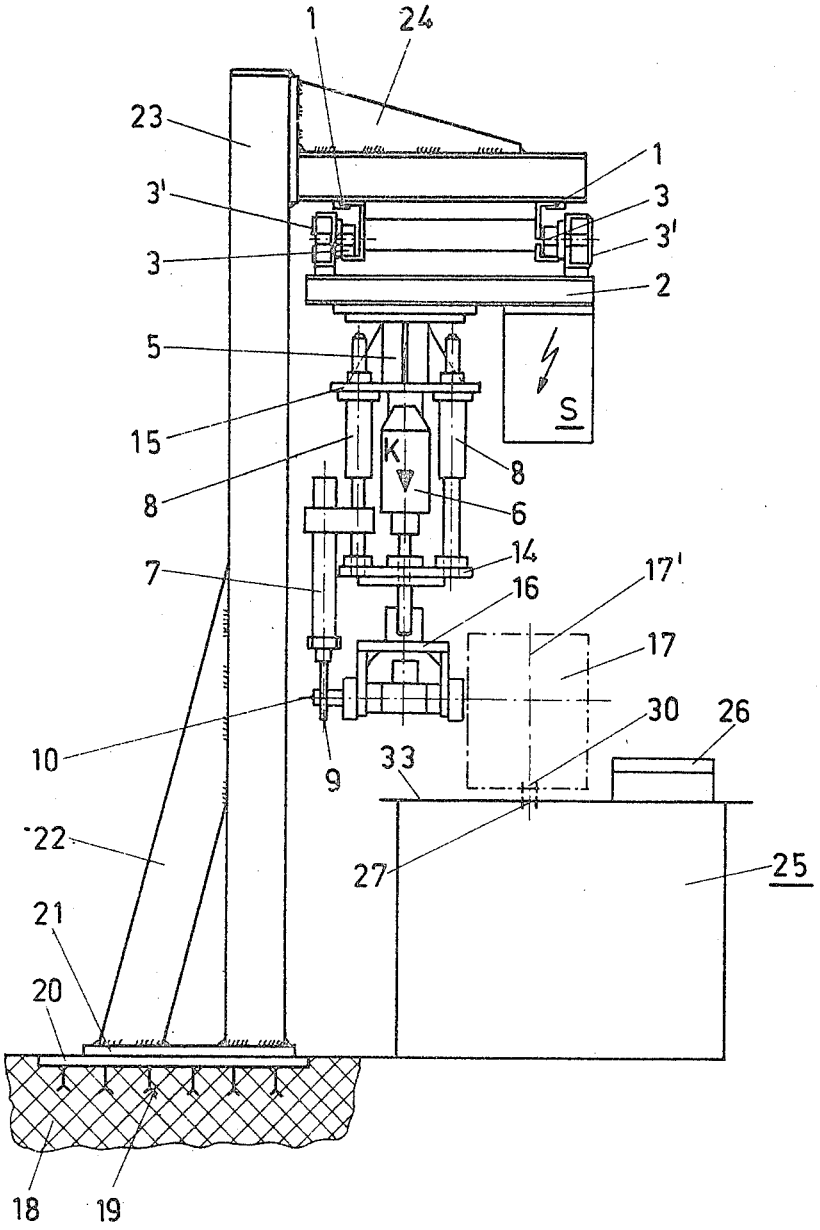
FIG. 3 is a side view of the casting apparatus depicted in FIG. 1.

The side view according to FIG. 3 shows further details of the inventive casting apparatus and the suspension thereof.

The two rails or tracks 1 which can be recognized are welded at their ends to a track or rail support 23 by means of webs or struts 24. The rail support 23, in turn, is welded to a support plate 21 and to a support 22. The entire construction is detachably connected to a foundation or base plate 20 which is fixed to a foundation 18 by means of armoring or reinforcement elements 19.

Above the carriage 2 there are arranged four rolls 3 equipped with lateral guides 3'. Underneath the carriage 2 there is provided a control block or unit S which serves for the electro-pneumatic control of all cylinder units.

The casting apparatus according to the invention is shown during the lowering of the mold 17 onto a cover plate 33 of the basin or vessel 25. There have been schematically illustrated the casting opening or hole 27 of the basin or vessel 25 as well as the casting or pour opening 30 of the mold 17. Equally schematically illustrated is a chute or shaft 26 provided with a suitable not particularly referenced closure or flap and serving for charging the basin or vessel 25.

After completely lowering the mold 17 onto the cover plate 33 the lifting or displacement cylinder 6 exerts an essentially perpendicular downwardly acting pressing or contact force K. Thus, there is achieved a form-locking or positive connection of the casting hole or opening 27 and the casting or pour opening 30 of the mold 17. Now the casting process can be performed.

The general schematic diagram of the entire casting assembly or unit 32 shown in FIG. 4 again illustrates the foundation plates 20, the supports 22, the two rail or track supports 23 and a simplified illustration of the track or rail 1. In front of the casting apparatus 32 there will be recognized the basin or vessel 25 and adjacent thereto a conventional cooling and finishing bath 28 containing a suitable finishing emulsion and housed in two containers 42 which are connected to one another by means of circulation conduits or lines 29. The one edge, designated by reference character O-O, of the basin or vessel 25 constitutes the origin of the system of coordinates in the horizontal plane. The casting or pour opening 27 is measured with respect to such origin, and equally the corresponding control functions of the casting apparatus are correlated to such edge or coordinate system-origin.

The space between the basin or vessel 25 and a part of the cooling and finishing bath 28 which has been designated by reference character W, constitutes a stripping station A. At this location the casting core 31 or the like is inserted while the casting apparatus is in a tilted or inclined position, which can best be seen by referring to FIG. 2. Also at this location the molded article is removed from the mold when such again is opened.

Figure 5:
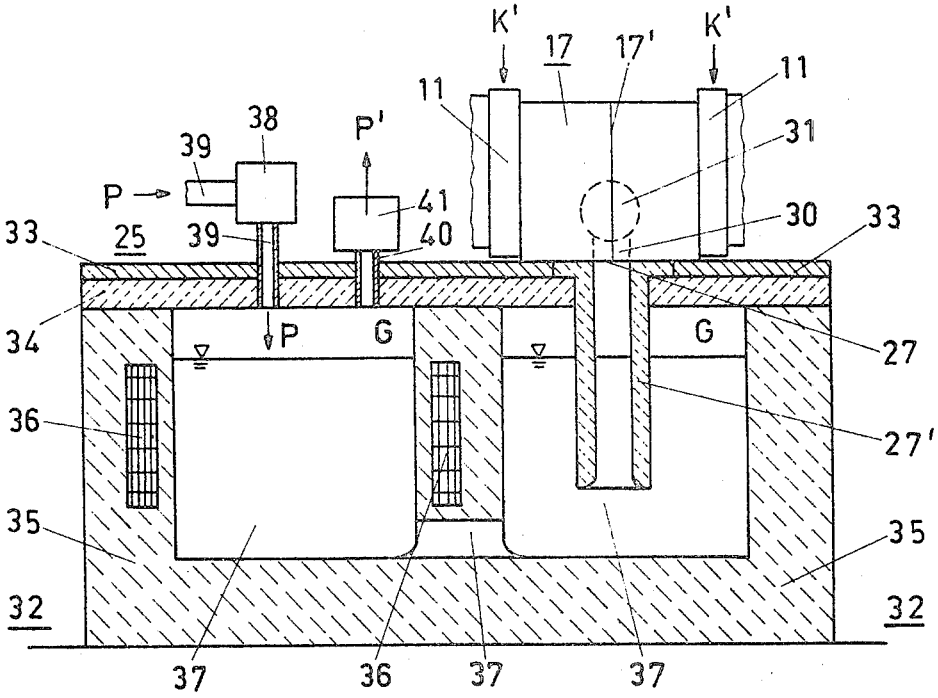
FIG. 5 is a sectional view of a melt containing basin or vessel containing two chambers.

With reference to FIG. 5 the actual casting process will be explained in greater detail.

The basin or vessel 25—sometimes called a crucible—is constructed as an enclosed pressure-tight double-chamber furnace. By means of an electrical heating arrangement 36 the melt 37 is heated to a point above the melting point of the casting material which, in the present case, is assumed to be a nonferrous metal. A ceramic lining or liner 35 serves as a heat insulator. At its bottom surface a metallic cover plate 33 is covered or clad with fine ceramics which equally serves as a heat insulator. A riser or up tube 27', likewise consisting of fine ceramics, immerses into the melt 37 and at its upper side is flushly inserted into the cover plate 33 by means of a suitable flange or the like. Located above the casting hole 27 is the casting or pour opening 30 of the mold 17. The two mold supports or holders 11 experience a pressing or contact force K' which is transmitted to the mold 17 flanged to the mold supports 11. By means of such pressing or contact force K', there is thus achieved a form-locking or positive and fluidtight transition between the mold 17 and the basin or vessel 25.

An infeed line or conduit 39 connects the left-hand chamber of the basin or vessel 25 with a here not further illustrated standard pressure or compressed air source which supplies an excess pressure p. Interposed in the line 39 is a controllable electro-valve 38 which controls the casting cycle. An outlet or discharge line 40 for the residual pressure p' is closed by means of an outlet or discharge valve 41.

Figure 4:
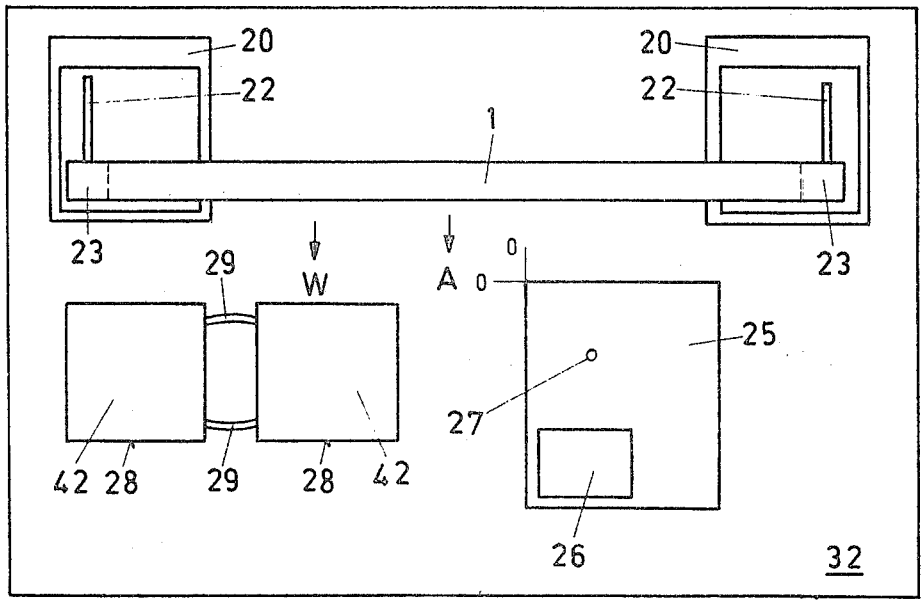
FIG. 4 is a simplified top plan view of a casting assembly or unit, wherein to simplify the showing the casting apparatus has not here been illustrated.

During the casting process the electro-valve 38 is opened so that within the gas chamber G located above the molten metal or melt 37 there is built-up the gas pressure p, which presses the melt 37 into the second chamber or compartment of the basin or vessel 25 located at the right-hand side of FIG. 4. Consequently, the gas chamber G located on this side of the basin 25 is compressed and the melt 37 is forced through the riser or up tube 27', the casting hole 27 and the casting or pour opening 30 and into the hollow space or compartment of the mold 17. The casting core 31, which here is constituted by a semisphere, is located with one-half thereof in a related one of the mold halves **17*a* and 17*b* which are divided by the mold parting plane or location 17'**.

After the mold 17 is accordingly formed i.e. molten metal cast and formed therein, it is displaced into a position above the cooling and finishing bath 28. At this location the two mold halves **17*a* and 17*b* of the mold 17 together with their closing cylinders 12 and the four column guides 13 are downwardly turned about the pivot or swivel shafts 16'** through 90° by means of two further conventional pneumatic pivot or swivel cylinders, the illustration of which has been conveniently omitted in order to simplify the illustration of the drawing.

Figure 6:
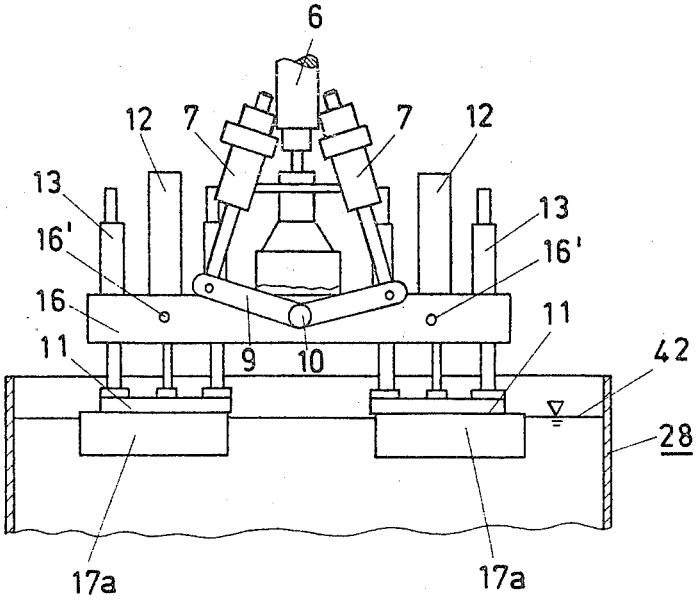
FIG. 6 is a partial view of the casting apparatus according to FIG. 1, shown during the cooling and finishing process.

By lowering the lifting or displacement cylinder 6 the two mold halves **17*a* and 17*b* immerse into the emulsion bath 28 as illustrated in FIG. 6**, this emulsion bath consisting of, for example, cooling water and blackwash or other suitable sizing agent or the like.

Figure 7:
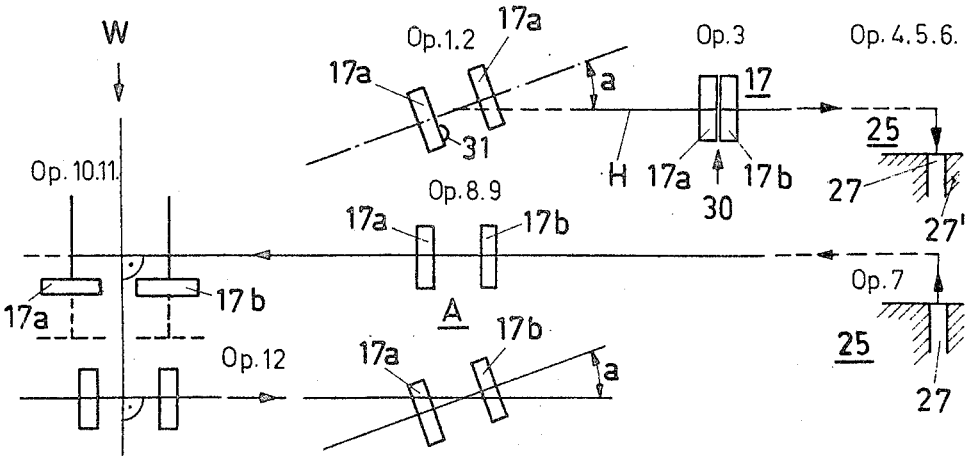
FIG. 7 schematically illustrates a characteristic course of operation during the manufacturing of molded parts containing hollow spaces or compartments.

By referring to FIG. 7 there will be seen the course of the operation which is characteristic for casting hollow bodies.

As a first operation a casting core, like the core 31 for instance, is inserted into the mold half **17*a* while the mold 17 is open and turned by about 20° with respect to the horizontal plane H; this is step or operation 1. The operator releases an electrical switching pulse or signal which causes the mold halves 17 and 17*b* to be closed; this is step or operation 2. Thereafter, the mold 17 is turned into its horizontal position and arrested or locked; this is step or operation 3. By horizontal displacement of the mold 17 in the direction of the arrow of FIG. 7 the casting or pour opening 30 is positioned above the casting hole or aperture 27 of the basin or vessel 25; this is step or operation 4. Thereafter, the mold 17 is lowered and pressed on to the casting hole 27 of the basin 25; this is step or operation 5. Then the melt is forced into the mold 17 in the previously described manner; this is step or operation 6. After a solidification period which is adapted to the cast piece or casting the mold 17 is vertically lifted off the casting hole 27; this constitutes step or operation 7. Thereafter, there is performed a horizontal displacement of the casting apparatus to the stripping station A; this is step or operation 8. At this location the casting or cast piece is manually removed from the mold 17; this is step or operation 9. Upon further manually releasing a switching pulse the mold 17 is transported to the washing, drying and finishing station W, where the mold halves 17*a* and 17*b* are turned by 90° and lowered, as previously described; this constitutes the steps or operations 10 and 11. After drying the two mold halves 17*a* and 17*b* the mold 17** again is displaced back into its original position; this is the step or operation 12.

The course of the operations, which have been demonstrated and described in conjunction with manufacturing brass armatures by way of example, can be adapted in almost any desired manner to other cast pieces and materials. Of course, for the fabrication of solid cast pieces or castings the steps of turning the mold and inserting the casting core can be omitted.

While there are shown and described preferred embodiments of the present invention, it is to be distinctly understood that the invention is not limited thereto but may be embodied and practiced within the scope of the following claims. Accordingly,

What we claim is:

1. A low-pressure casting method for the casting of cast pieces within a displaceably arranged mold containing mold halves and a casting opening, comprising the steps of:

providing a substantially pressure-tight closed vessel containing a cover plate at its upper side equipped with a casting hole;

providing within said vessel which contains a molten metal a gas chamber above the molten metal;

displacing said mold in a substantially vertical plane prior to casting;

said step of displacing said mold including lowering said mold together with its casting opening onto said casting hole of said metal-containing vessel;

placing said lowered mold with its casting opening into form-locking alignment with said casting hole of said vessel;

pressing said mold onto the cover plate of said vessel;

applying a gas pressure to said gas chamber to force the molten metal through the casting hole of the vessel and through the casting opening of the mold into the mold;

solidifying the cast piece formed in the mold;

venting the gas chamber following the solidification of the cast piece in the mold;

then further displacing said mold in said substantially vertical plane;

lifting the mold in a substantially vertical direction off of the vessel following venting of the gas chamber;

transporting the lifted mold in a substantially horizontal linear direction to a stripping station;

opening said mold at the stripping station;

removing the cast piece from the mold;

further displacing the mold following removal of the cast piece in a substantially linear direction to a washing, drying and finishing station;

rotating the mold halves of the mold within said vertical plane through an angle of approximately 90° in order to open the mold; and lowering the mold halves at the location of a parting plane thereof such that frontal surfaces of the opened mold halves are lowered and immersed into a cooling and finishing emulsion bath at the washing station.

2. The low-pressure casting method as defined in claim 1, including the steps of:

turning the mold with the mold halves open into an inclined position prior to casting;

inserting a casting core into at least one of the open mold halves; and closing the mold and turning the closed mold back into a substantially horizontal position.

3. An apparatus for the low-pressure casting of cast pieces within a displaceably arranged mold possessing mold halves and a casting opening, comprising:

a substantially pressure-tight closed vessel provided with a cover plate at its upper side containing a casting hole;

said pressure-tight vessel containing a molten metal therein which is to be cast and a gas chamber above the molten metal;

track means;

a carriage for supporting the mold;

means for displaceably mounting said carriage at said track means;

said displaceably mounting means including structure for displacing said mold towards said pressure-tight vessel in order to press said mold onto said cover plate of said vessel and with said casting opening of the mold in form-locking alignment with said casting hole of said vessel in an essentially leakage-free manner and without the use of any sealing means interposed between the casting opening and the casting hole;

said structure of said displaceably mounting means enabling said mold to be moved in a substantially vertical plane prior to the casting operation;

said structure comprises a fluid-operated displacement device interposed between said carriage and said mold; and said displacement device comprises at least one fluid-operated lifting cylinder and two pivoting cylinders acting upon a double-arm lever.

4. The apparatus as defined in claim 3, further including:

mold supports provided for the mold halves of said mold; and a locking cylinder provided for each of said mold halves.

5. The apparatus as defined in claim 4, further including:

column guide means for substantially parallely guiding said mold halves.

6. The apparatus as defined in claim 3, wherein:

said structure comprises a displacement device; and column guide means for vertically guiding said displacement device.

7. The apparatus as defined in claim 3, further including:

means defining a mold stripping station;

means defining a washing, drying and finishing station; and said track means being guided over said vessel, said stripping station and said washing drying and finishing station.

* * * * *